US007275855B2

(12) United States Patent
Protsch et al.

(10) Patent No.: US 7,275,855 B2
(45) Date of Patent: Oct. 2, 2007

(54) VEHICLE LAMP

(76) Inventors: Matthias Protsch, Koppenplatz 13, Berlin (DE) 10115; Thomas Schmidt-Lehmann, Elsternstieg 9, Kleinmachnow (DE) 14532

( * ) Notice: Subject to any disclaimer, the term of this patent is extended or adjusted under 35 U.S.C. 154(b) by 72 days.

(21) Appl. No.: 11/132,381

(22) Filed: May 19, 2005

(65) Prior Publication Data

US 2005/0259432 A1 Nov. 24, 2005

(30) Foreign Application Priority Data

May 19, 2004 (DE) ..... 102004025268

(51) Int. Cl.
*H01R 33/00* (2006.01)

(52) U.S. Cl. ..... 362/652; 362/548; 362/651

(58) Field of Classification Search ..... 362/651, 362/548, 549, 652
See application file for complete search history.

(56) References Cited

U.S. PATENT DOCUMENTS 6,031,323 A * 2/2000 Behr et al. ..... 313/318.01
6,981,793 B2 * 1/2006 Behr et al. ..... 362/651
7,004,609 B2 * 2/2006 Behr et al. ..... 362/549
7,097,343 B2 * 8/2006 Tiesler-Wittig et al. ..... 362/651
2005/0041420 A1 * 2/2005 Tiesler-Wittig et al. ..... 362/226

FOREIGN PATENT DOCUMENTS

EP 0786791 7/1997

* cited by examiner

*Primary Examiner*—Sandra O'Shea
*Assistant Examiner*—James W Cranson, Jr.
(74) *Attorney, Agent, or Firm*—William E. Meyer

(57) ABSTRACT

The invention relates to a vehicle lamp having a lamp base, which is equipped with the electrical connections of the vehicle lamp, the lamp base (2) having a plastic base part (20) which has at least one integrally formed stud (21), which serves the purpose of mounting the vehicle lamp in the vehicle headlight and which is provided with reinforcing means (31) in order to increase its mechanical robustness.

6 Claims, 6 Drawing Sheets

VEHICLE LAMP

I. TECHNICAL FIELD

Figure 1:
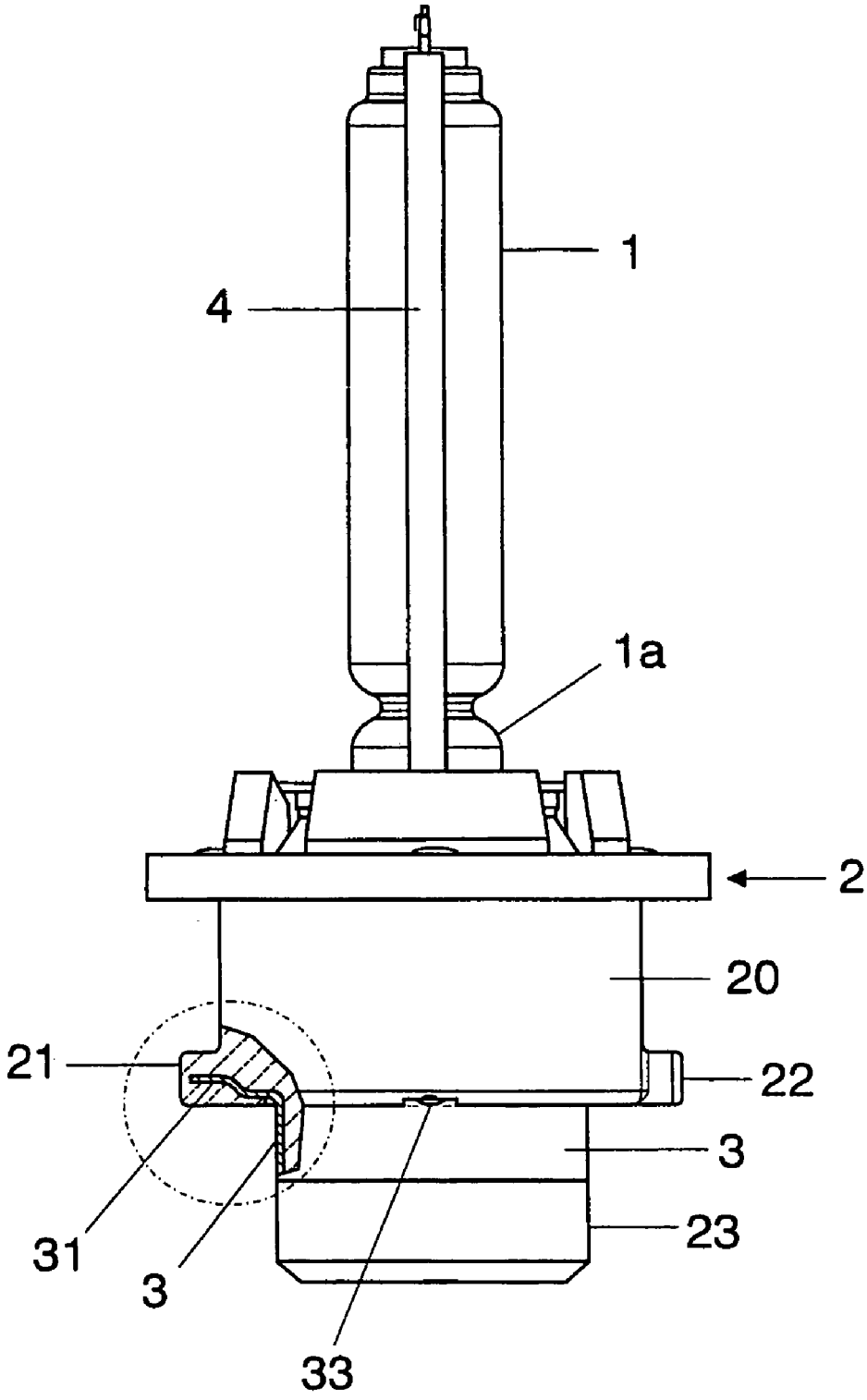

The invention relates to a vehicle lamp having a lamp base, which is equipped with the electrical connections of the vehicle lamp, the lamp base having a plastic base part which has at least one integrally formed stud, which serves the purpose of mounting the vehicle lamp in the vehicle headlight.

II. BACKGROUND ART

Such a vehicle lamp is disclosed, for example, in the European laid-open specification EP 0 786 791 A1. This vehicle lamp has a lamp base having a cylindrical base sleeve made of plastic, which is provided with two diametrically arranged studs made of plastic which point radially outwards and which serve the purpose of mounting the lamp in a vehicle headlight.

It has been shown that the mechanical robustness of these studs is insufficient for them to be used as part of a latching mechanism, in particular of a bayonet fitting, with the vehicle headlight.

III. DISCLOSURE OF THE INVENTION

It is the object of the invention to provide a generic vehicle lamp having an improved lamp base which avoids the abovementioned disadvantage.

This object is achieved according to the invention by a vehicle lamp having a lamp base, which is equipped with the electrical connections of the vehicle lamp, the lamp base having a plastic base part which has at least one integrally formed stud, which serves the purpose of mounting the vehicle lamp in the vehicle headlight, wherein said at least one stud is provided with reinforcing means. Particularly advantageous embodiments of the invention are described in the dependent patent claims.

The vehicle lamp according to the invention has a lamp base, which is provided with the electrical connections of the vehicle lamp and is provided with a plastic base part which has at least one integrally formed stud, which serves the purpose of mounting the vehicle lamp in the vehicle headlight and is equipped with reinforcing means. The reinforcing means increase the mechanical robustness, in particular the resistance to breakage, of the at least one stud, with the result that it can be formed as part of a latching mechanism for the purpose of fixing the vehicle lamp in the lampholder of the vehicle headlight.

Advantageously used as the reinforcing means is a metal sheet which is at least partially embedded in the plastic material of the plastic base part. The metal sheet increases the mechanical robustness of the at least one stud such that the at least one stud can be formed as part of a latching apparatus, preferably a bayonet fitting. A suitable material for the metal sheet is, for example, stainless steel or spring steel. The metal sheet is advantageously either embedded in the plastic material of the at least one stud or formed such that it covers at least part of the outer surface of the at least one stud. In accordance with a preferred exemplary embodiment, the abovementioned metal sheet is in the form of a lug which is integrally formed on a metal ring. By means of the metal ring, the at least one lug can be positioned exactly in the casting mold for the plastic base part provided with the stud, in order for it then to be embedded in the material of the corresponding stud by means of a plastic injection-molding process. The abovementioned metal ring also has the advantage that it can additionally be used as an electrical connection for the vehicle lamp.

IV. BRIEF DESCRIPTION OF THE DRAWINGS

Figure 2:
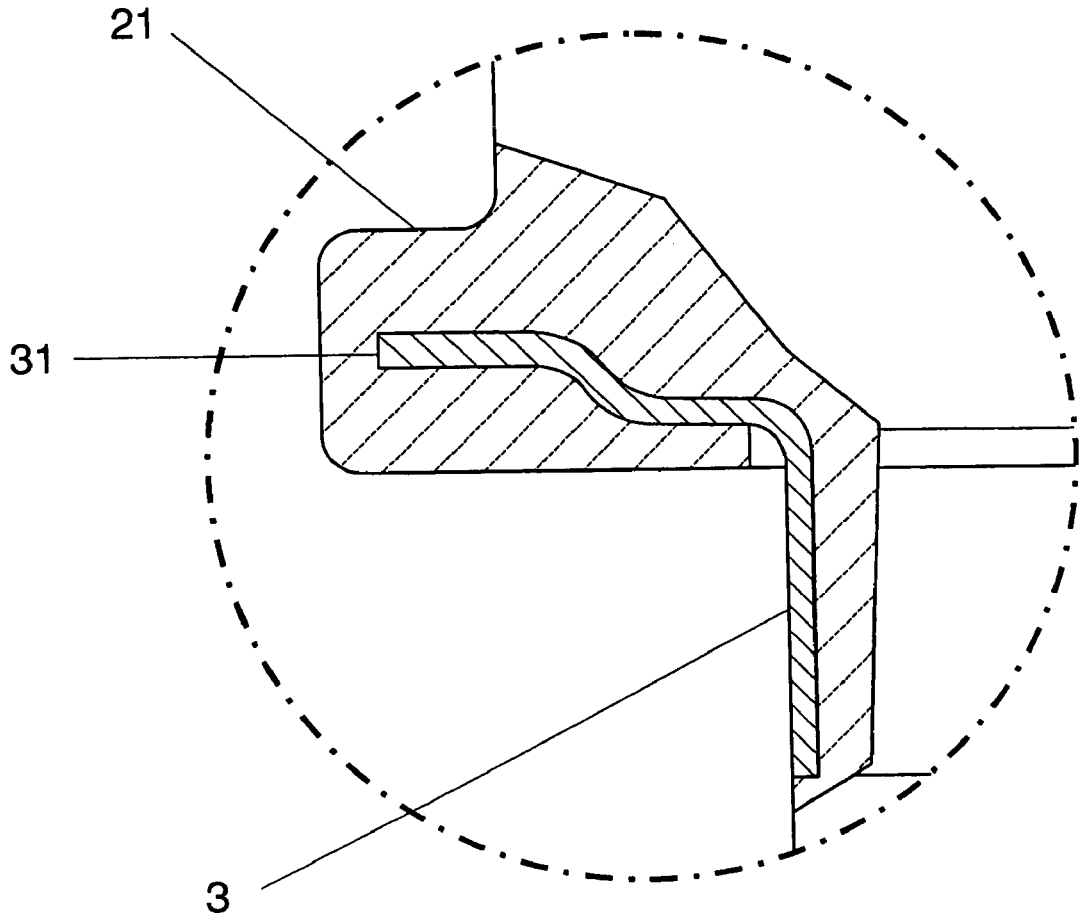
Figure 3:
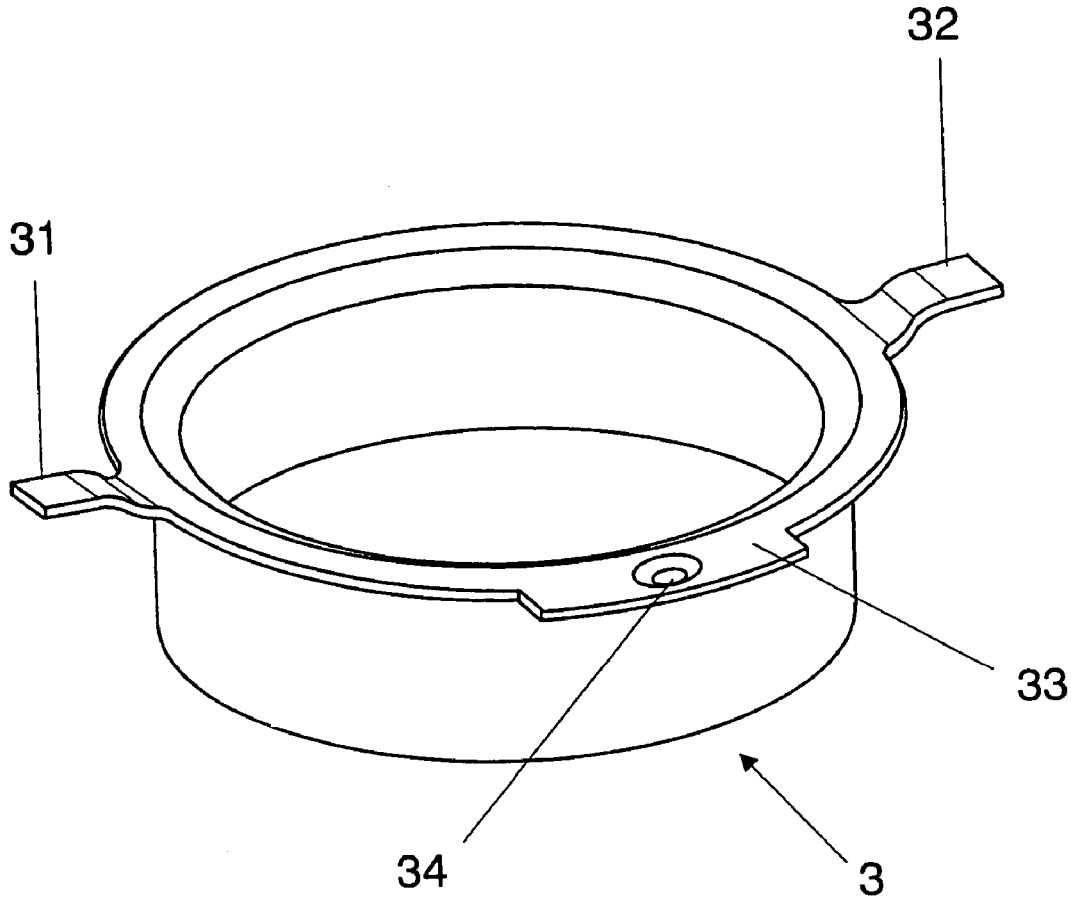
Figure 4:
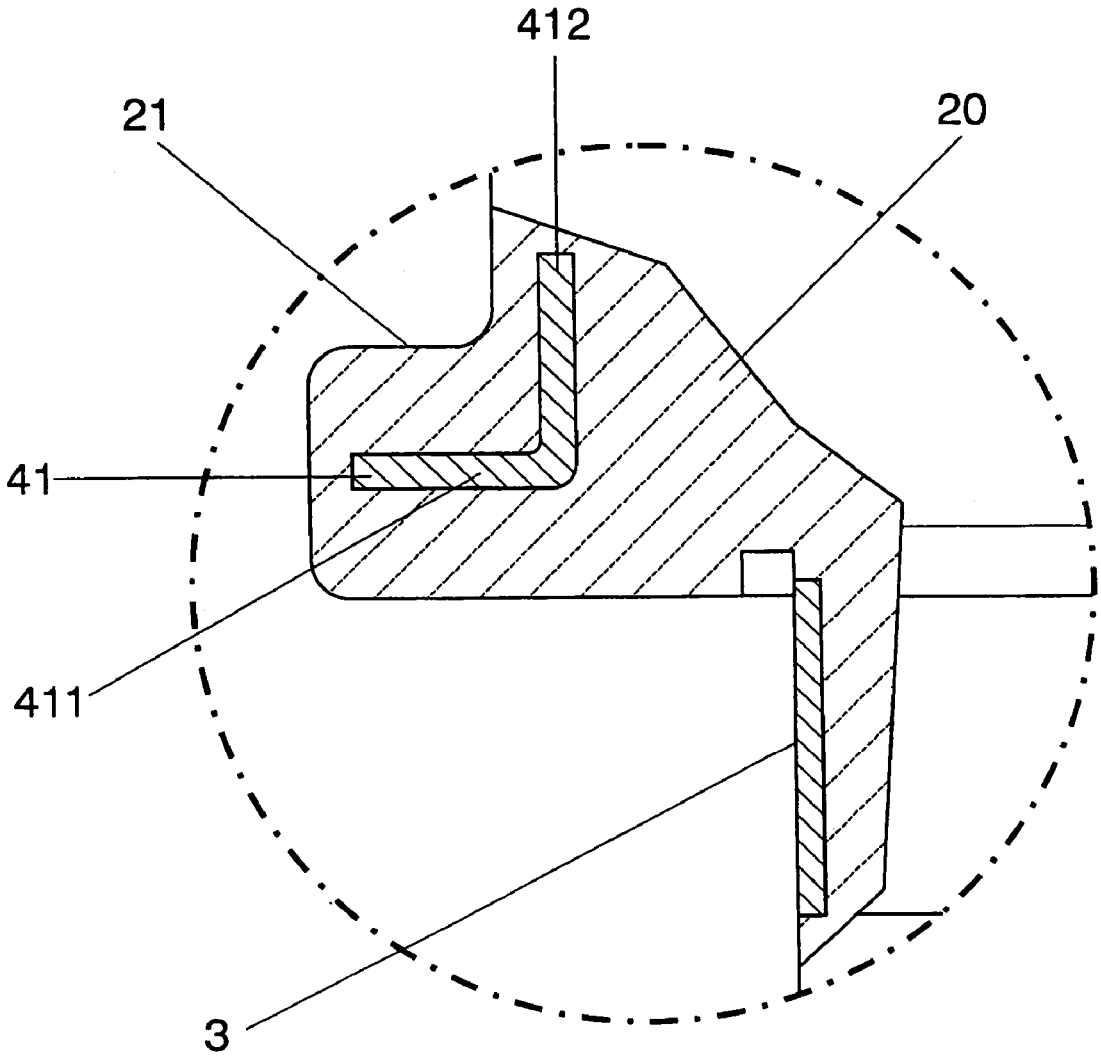
Figure 5:
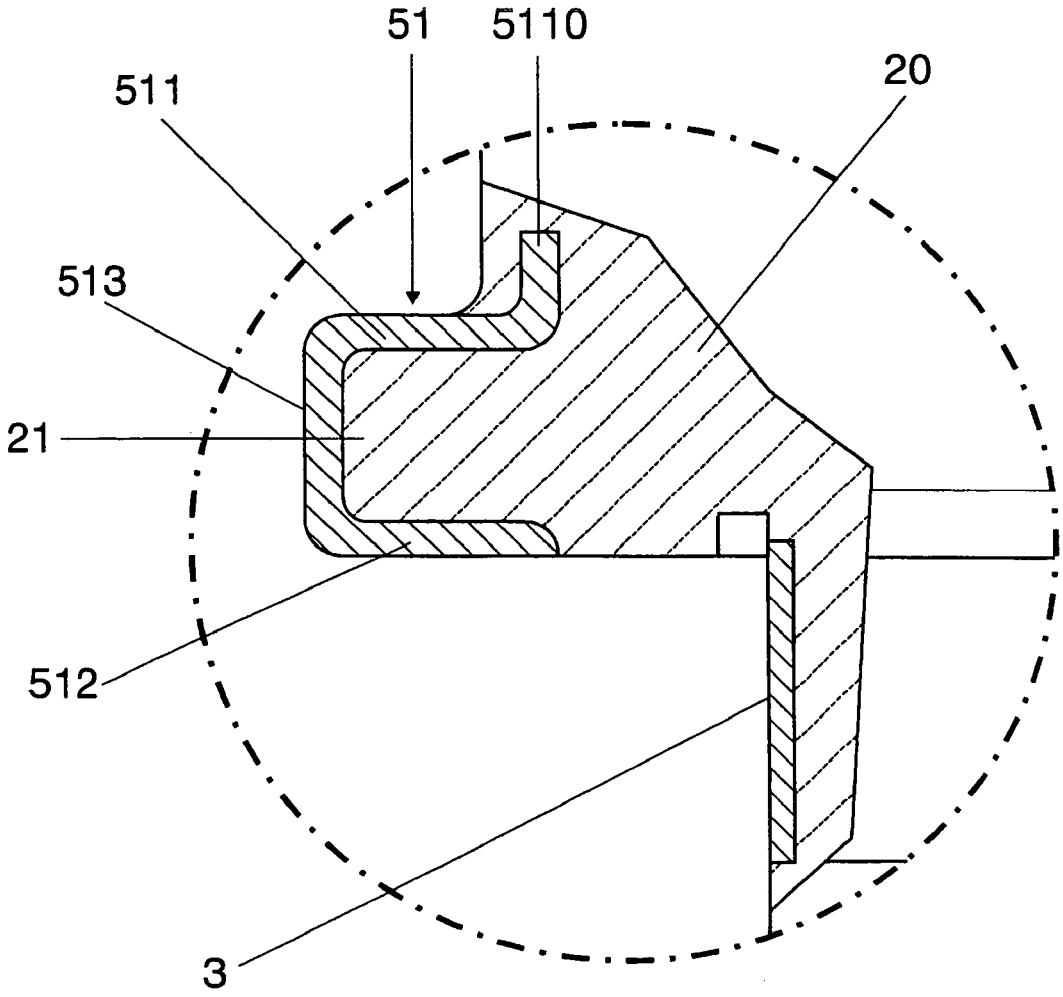
Figure 6:
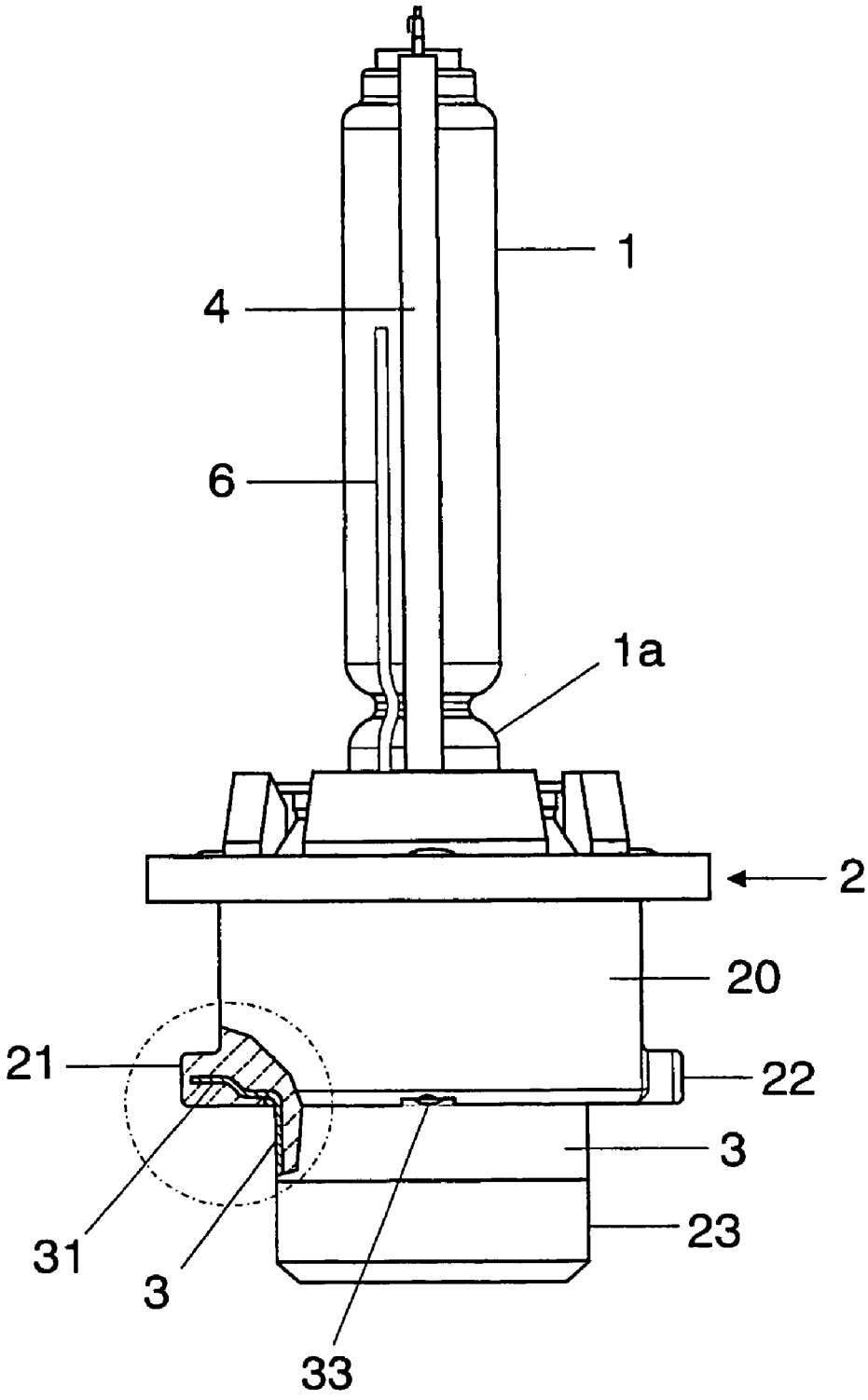

The invention will be explained in more detail below with reference to a preferred exemplary embodiment. In the drawing:

FIG. 1 shows a partially sectioned, schematic illustration of a side view of a vehicle lamp in accordance with a preferred exemplary embodiment of the invention, FIG. 2 shows an enlarged illustration of the section of the lamp base, which is depicted in cross section in FIG. 1, in accordance with the first exemplary embodiment of the invention, FIG. 3 shows a schematic illustration of the annular, electrical connection of the vehicle lamp depicted in FIG. 1, FIG. 4 shows an enlarged illustration of the section of the lamp base, which is depicted in cross section in FIG. 1, in accordance with the second exemplary embodiment of the invention, FIG. 5 shows an enlarged illustration of the section of the lamp base, which is depicted in cross section in FIG. 1, in accordance with the third exemplary embodiment of the invention, and FIG. 6 shows a partially sectioned, schematic illustration of a side view of a vehicle lamp in accordance with a fourth exemplary embodiment of the invention with an auxiliary starting electrode on the protective bulb.

V. BEST MODE FOR CARRYING OUT THE INVENTION

The preferred exemplary embodiment of the invention depicted in FIG. 1 is a high-pressure discharge lamp, in particular a halogen metal-vapor high-pressure discharge lamp having an electrical power consumption of approximately 35 watts, which is envisaged for use in a motor vehicle headlight.

This high-pressure discharge lamp has a discharge vessel, in the interior of which are arranged gas discharge electrodes and an ionizable filling comprising xenon and metal halides for the purpose of producing a gas discharge, and which is surrounded by a transparent, cylindrical protective bulb 1. The protective bulb 1 is fixed directly to the discharge vessel. A tubular protrusion l*a* of the protective bulb 1 is fixed in the plastic lamp base 2 of the high-pressure discharge lamp. Details on the discharge vessel, the protective bulb 1 and the manner in which it is fixed in the lamp base 2 are described, for example, in laid-open specification EP 0 786 791 A1.

The lamp base 2 has a cylindrical base sleeve 20, which is made from an electrically insulating thermoplastic withstanding high temperatures and which has two integrally formed, diametrically arranged studs 21, 22. The two studs 21, 22 extend along a diameter of the base sleeve 20 and are integrally formed on the outside of the base sleeve 20. The thickness of the studs 21, 22, i.e. their extent in the longitudinal direction of the lamp, is 3 mm. The end 23 of the lamp base 2 which is remote from the protective bulb 1 is in the form of a plug and is equipped with the electrical connections of the lamp. One electrical connection of the vehicle lamp is in the form of an annular metal contact 3 which forms part of the outside of the end 23 in the form of a plug. The second electrical connection is an axially arranged contact pin, which cannot be seen in the side view in FIG. 1. Details of this contact pin are described, for example, in the above-cited laid-open specification.

The annular metal contact 3 is depicted in FIG. 3. It is made of stainless steel. The annular metal contact 3 has two integrally formed, diametrically arranged lugs 31, 32 which extend radially outwards. These lugs 31, 32 are each embedded in the plastic material of a stud 21 and 22, respectively. The lugs 31, 32 are embedded in this manner in the plastic material of the studs 21, 22 during the manufacturing process of the base sleeve 20 by means of a plastic injection-molding process. In addition, the annular metal contact 3 has an integrally formed welding tab 33, which is bent back in the radial direction, is provided with an aperture 34 and serves the purpose of making electrical contact with the power supply wire of the power return line 4. The lugs 31, 32 have a thickness or a metal sheet thickness of 0.4 mm. The free ends of the lugs 31, 32 are embedded centrally in the plastic material of the respective stud 21 and 22, as illustrated schematically in FIG. 2.

FIGS. 4 and 5 show two further exemplary embodiments for reinforcing the studs 21, 22 of the high-pressure discharge lamp described in more detail above. These exemplary embodiments differ only in terms of the metal sheets which are embedded in the studs 21, 22 or which surround the studs 21, 22. In all of the figures, the same reference numerals have also been used for identical lamp parts.

In accordance with the second exemplary embodiment of the invention depicted in FIG. 4, a bent-back metal sheet 41 is embedded in each stud 21, 22 of the base 20 of the high-pressure discharge lamp. A first limb 411 of the metal sheet 41 extends into the studs 21 or 22 and is completely surrounded by the plastic material of the stud. The second limb 412 of the metal sheet 41 is bent back at right angles from the first limb 411 and is embedded in the plastic material of the cylindrical base part 20. The metal sheet 41 is not connected to the annular contact 3.

In accordance with the third exemplary embodiment of the invention depicted in FIG. 5, the upper side and the underside as well as that end face of the stud 21 or 22 which is oriented perpendicular to the radius of the lamp base 20 are surrounded by a metal sheet 51 which is essentially in the form of a U. The majority of the surface of the stud 21 or 22 is therefore formed by the metal sheet 51. The U limb 511 of the metal sheet 51, which covers the upper side of the stud 21 or 22, is provided with a lug 5110, which is bent back at right angles from the U limb 511 and is embedded in the plastic material of the base 20. The second U limb 512 covers the underside of the stud 21 or 22, whereas the connecting section 513 of the U limbs 511, 512 covers the abovementioned end face of the stud 21 and 22, respectively. The metal sheet 51 is not connected to the annular contact 3.

The second limb 412 of the metal sheet 41 in accordance with the second exemplary embodiment of the invention or the lug 5110 of the metal sheet 51 in accordance with the third exemplary embodiment of the invention can be electrically conductively connected within the base 20 to an auxiliary electrode of the high-pressure discharge lamp, for example to an auxiliary starting electrode 6 of the high-pressure discharge lamp, the auxiliary starting electrode 6 being applied, for example, as an electrically conductive coating to the protective bulb 1 of the high-pressure discharge lamp, as is illustrated in FIG. 6 in accordance with the fourth exemplary embodiment. The electrical contact to the voltage source can be produced, for example, by means of the first limb 411 of the metal sheet 41 which is embedded in the stud 21 and which can protrude from the stud 21 for this purpose, or realized by means of the U limbs 511, 512 of the metal sheet 51 which partially cover the surface of the stud 21. However, the auxiliary starting electrode 6 may also be electrically conductively connected to the power return line 4 or be designed to be DC-isolated from the electrodes and power supply lines of the high-pressure discharge lamp. The fourth exemplary embodiment corresponds to the exemplary embodiment depicted in FIG. 1 in all details except for the auxiliary starting electrode 6 and the way in which contact is made with said auxiliary starting electrode 6.

In all of the exemplary embodiments, the metal sheets are made of stainless steel or spring steel. The plastic base 20 and the studs 21 integrally formed therewith are made of a plastic which can be subjected to high thermal loads, from the group consisting of polyetherimide (PEI), polyphenylenesulfide (PPS) and liquid crystal polymer (LCP). Polyetherimide, which is also known under the trade name ULTEM®, has a glass fiber content of 30 percent, and the studs 21 show a strength of more than 500 newtons, even without the metallic reinforcing means. The elongation at break of this material is 2 percent. In the case of the liquid crystal polymer (LCP), which is also known under the trade name Vectra® or Zenite®, the content of glass fibers in the material is between 30 percent and 50 percent. In this case, the stud strength is approximately 150 newtons to 200 newtons, without metallic reinforcing means. The elongation at break has a value of 1.5 percent. LCP is a severely anisotropic, highly crystalline material, which forms crystalline regions even in the liquid phase, such that, the stud strength can be optimized by suitably aligning the crystals during casting and injection-molding of the base 20.

What is claimed is:

1. A vehicle lamp having comprising: a lamp base, which is equipped with electrical connections for the vehicle lamp, the lame base having a plastic base part which has at least one integrally formed stud, which serves the purpose of mounting the vehicle lamp in a vehicle headlight, wherein said at least one stud is provided with reinforcing means, and wherein the reinforcing means comprise a metal sheet which is at least partially embedded in the plastic material of the plastic base part.

2. The vehicle lamp as claimed in claim 1, wherein said metal sheet is in the form of a lug which is integrally formed on a metal ring.

3. The vehicle lamp as claimed in claim 2, wherein the metal ring is in the form of an electrical connection of the vehicle lamp.

4. The vehicle lamp as claimed in claim 1, wherein said metal sheet extends into the plastic material of said at least one stud.

5. The vehicle lamp as claimed in claim 1, wherein the metal sheet forms at least part of the outer surface of said at least one stud.

6. The vehicle lamp as claimed in claim 1, wherein the metal sheet is electrically conductively connected to an auxiliary starting electrode.

* * * * *